US005171156A

United States Patent [19]

Nagasaka et al.

[11] Patent Number: 5,171,156

[45] Date of Patent: Dec. 15, 1992

[54] LOW-OPERATING-FORCE CONNECTOR

[75] Inventors: Yasuhiro Nagasaka, Aichi; Naoto Taguchi, Shizuoka, both of Japan

[73] Assignees: Toyota Jidosha Kabushiki Kaisha, Toyota; Yazaki Corporation, Tokyo, both of Japan

[21] Appl. No.: 814,890

[22] Filed: Jan. 2, 1992

[30] Foreign Application Priority Data

Jan. 11, 1991 [JP] Japan ..... 3-3408[U]

[51] Int. Cl.[5] ..... H01R 13/629

[52] U.S. Cl. ..... 439/157

[58] Field of Search ..... 439/152-160

[56] References Cited

U.S. PATENT DOCUMENTS

| | | | |
|---|---|---|---|
| 2,161,353 | 6/1939 | Hummel | 439/160 |
| 3,392,245 | 7/1968 | Asick | 200/16 |
| 4,303,292 | 12/1981 | McNeel | 439/152 |
| 4,332,432 | 6/1982 | Colleran | 339/75 |
| 4,586,771 | 5/1986 | Kraemer et al. | 339/75 |
| 5,115,376 | 5/1992 | Nakajima et al. | 439/160 |

FOREIGN PATENT DOCUMENTS 1-88474 6/1989 Japan . .

1442837 7/1976 United Kingdom .

*Primary Examiner*—Joseph H. McGlynn

*Attorney, Agent, or Firm*—Armstrong & Kubovcik

[57] ABSTRACT

The rotary plate of the cam member is formed with cam grooves symmetrical about the rotating shaft of the rotary plate. The rotating shaft has a rotary retainer plate at its end. A pair of mating housings are each provided with a cam follower pin that engages with the respective cam grooves. One of the housings is formed with a pin guide groove that guides the rotating shaft of the cam member and the cam follower pin of the other housing. At the dead end of the pin guide groove is formed an enagement completion opening from which the rotary retainer plate can be pulled out when the both housings are completely engaged together. The fact that the mating female and male housings are engaged or disengaged by the rotating operation of the cam member and that the cam member is allowed to be removed only when the mating housings are completely engaged, prevents any incomplete engagement of the housings and assures highly reliable electrical connections while at the same time requiring a small operating force during the engagement process.

4 Claims, 5 Drawing Sheets

LOW-OPERATING-FORCE CONNECTOR

BACKGROUND OF THE INVENTION

1. Field of the Invention

The present invention relates to an improvement of a low-operating-force connector in which female and male housings can be connected and disconnected with a small operating force by means of a cam member.

2. Description of the Prior Art

A conventional connector of this kind, as illustrated in FIGS. 5 and 6, has been proposed by the Japanese Utility Model Preliminary Publication No. Heisei 1-88474. It consists of a female housing a, a male housing b and an operating member c. The female housing a has a rotary shaft $a_2$ projecting from a hood $a_1$; the male housing b has a cam follower $b_1$ projecting therefrom; and the operating member c consists of a rotating plate $c_1$ formed with a hole $c_2$ as a rotating center and a cam groove $c_3$. The rotary moment of the operating member c is utilized to effect the coupling and decoupling of the female and male housings a, b with a small operating force.

As can be seen from FIG. 6, the engagement of the female and male housings a, b is completed when the operating member c has fully rotated and the cam follower $b_1$ has reached the far end $c_{31}$ of the cam groove $c_3$. The operating member c can be easily removed at any point of the engagement process, from the initial to the final stage of the process. Hence, there is a possibility of an assembly worker removing the operating member c with the female and male housings a, b incompletely connected. It is difficult to tell at a glance whether the housing connection is complete or not.

SUMMARY OF THE INVENTION

The present invention has been accomplished with a view to overcoming the above-mentioned drawback and is intended to provide a low-operating-force connector which allows the cam member or operating member to be removed only when the female and male housings engage completely, thus assuring the complete engagement of the connector housings.

To achieve the above objective, the low-operating-force connector of this invention, as stated in the claim, comprises: a cam member consisting of a rotary plate, said rotary plate being formed with two cam grooves symmetrical about a rotating shaft of the rotary plate and with introductory grooves leading to the cam grooves, said rotating shaft having a rotary retainer plate at the end thereof; and a pair of mating housings adapted to be engaged or disengaged by rotating the cam member, said paired housings each having a cam follower pin that engages with the corresponding cam groove of the cam member, one of said paired housings being provided with a pin guide groove that guides the cam follower pin of the other housing and the rotating shaft of the cam member, said pin guide groove having at its dead end an engagement completion opening from which the rotary retainer plate of the rotating shaft of the cam member can be pulled out when the paired housings are completely engaged together.

With this low-operating-force connector, as the cam member is rotated with the cam follower pins engaged in the cam grooves, the female and male housings move closer to each other toward the rotating shaft of the cam member. This ensures smooth engagement of the mating housings. During the engagement process, the rotating shaft of the cam member moves along the pin guide groove. When the female and male housings are completely engaged, the rotary retainer plate reaches the engagement completion opening at the dead end of the pin guide groove. Only in this state can the cam member be removed from the connector.

In other words, since the cam member cannot be removed during the engagement process, a complete connection of the housings is assured. In an inspection process, whether or not the housings are engaged can be easily and reliably determined by simply checking the presence or absence of the cam member on the connector.

DETAILED DESCRIPTION OF PREFERRED EMBODIMENT

Figure 1:
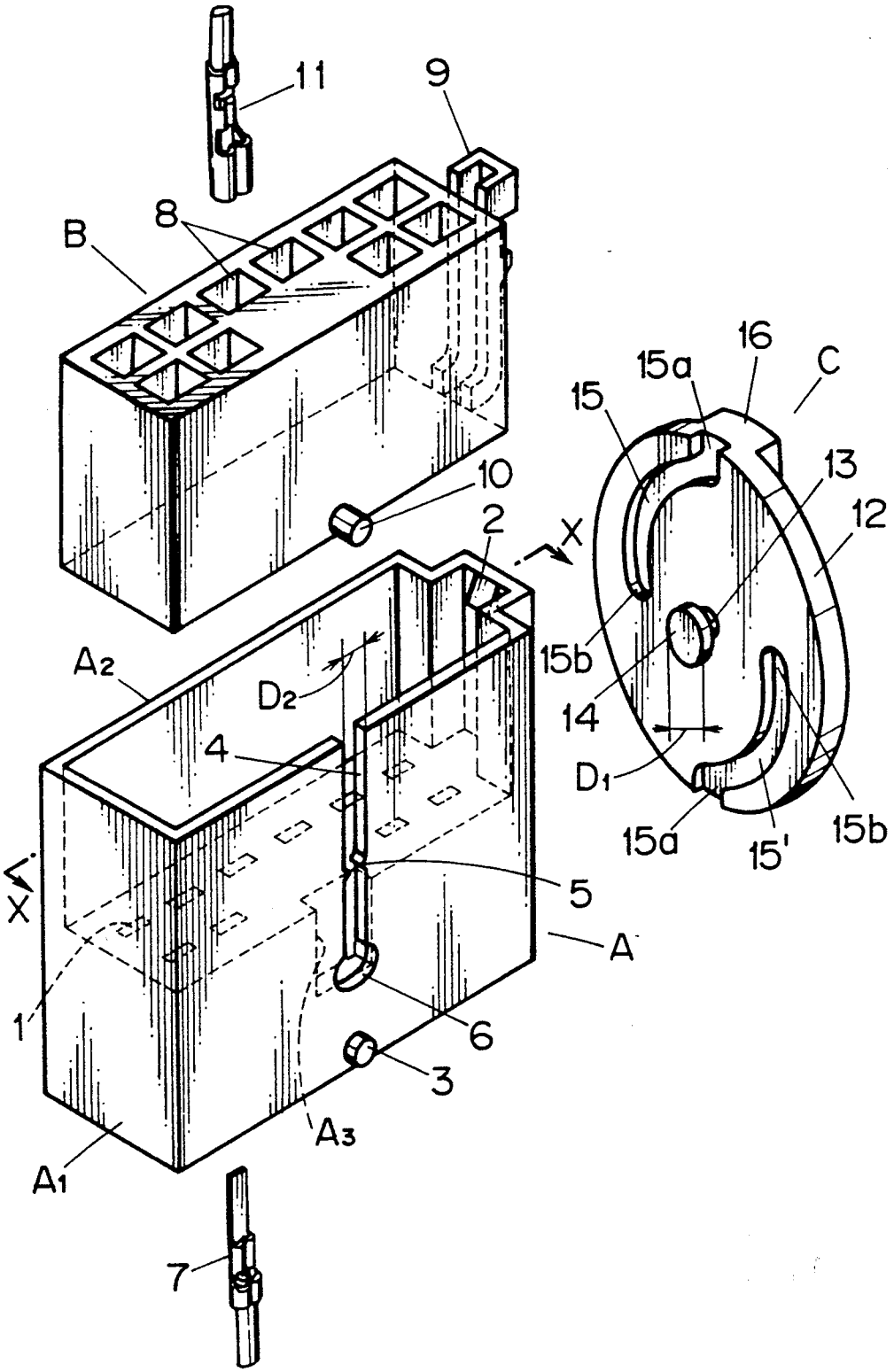
FIG. 1 is a perspective view of the low-operating-force connector as one embodiment of the invention, with the female and male housings and the cam member separated from each other.
Figure 2:
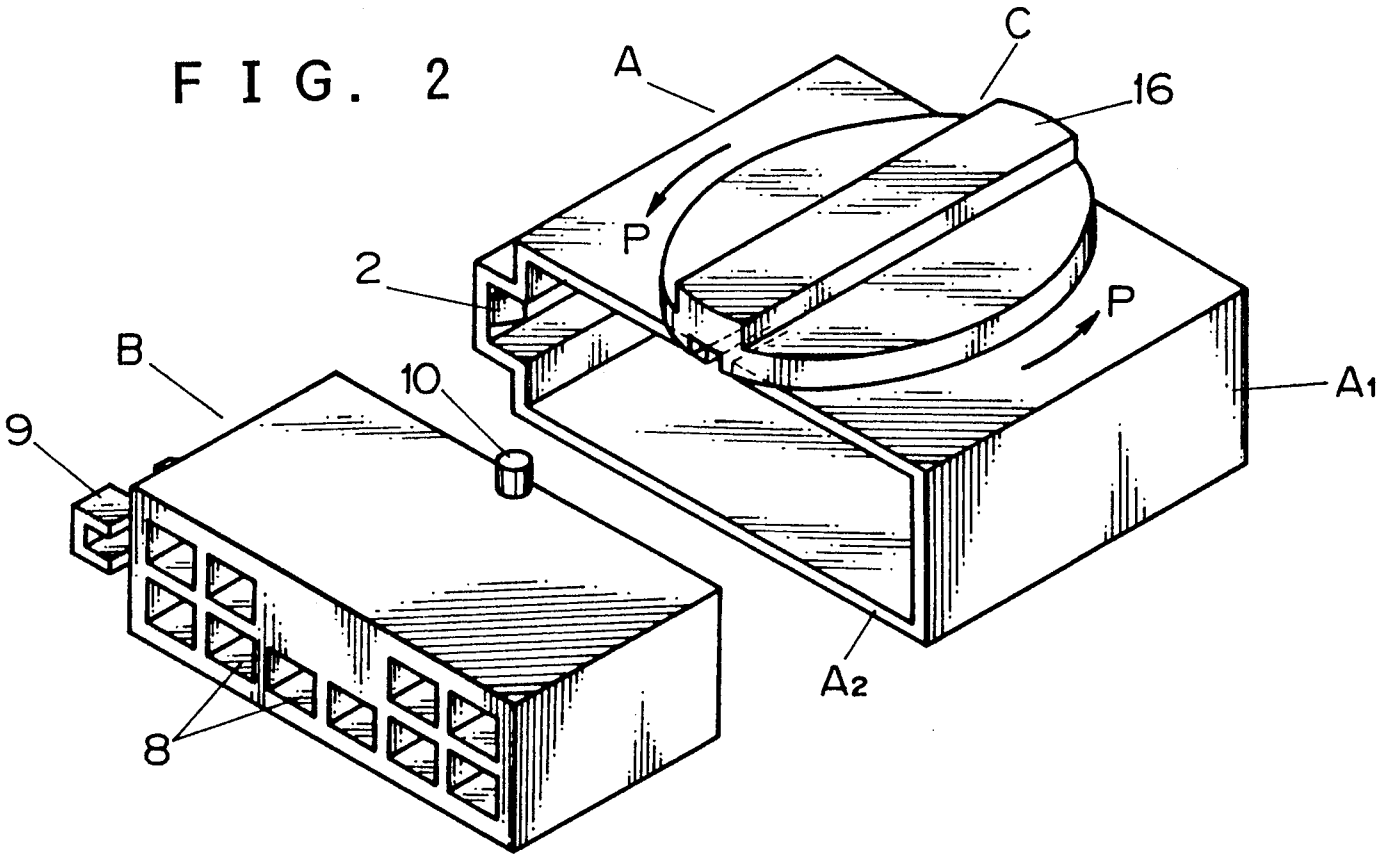
FIG. 2 is a perspective view of the connector of FIG. 1 with the cam member mounted to the female housing.

Referring to FIGS. 1 and 2, designated A is a female housing, B a male housing, and C a cam member for engaging and disengaging the two housings, all the three members being made of synthetic resin. The mating female and male housings A, B each have terminal accommodating chambers 1, 8 in which male terminals 7 and female terminals 11 respectively are installed.

The female housing A consists of a housing body $A_1$ containing a plurality of terminal accommodating chambers 1 and a hood $A_2$ formed in front of the housing body for receiving the male housing B. The hood $A_2$ has at one end wall a locking portion 2 for locking the male housing B. A cam follower pin 3 is projected from one of facing side walls of the female housing A at the center of the lower end portion thereof. The side wall having the cam follower pin is formed with a pin guide groove 4 above the cam follower pin 3.

The pin guide groove 4 is open at the edge of the hood $A_2$ and extends in the direction of relative engaging movement of the female and male housings. The lower end of the pin guide groove 4 is located at a point facing a recess $A_3$ in the housing body $A_1$ and forms an elliptical engagement completion opening 6, whose major axis (or longest diameter) is directed perpendicular to the pin guide groove 4. At an intermediate portion, the pin guide groove 4 has a preliminary locking projection 5.

The male housing B has formed at one of its end walls a resilient locking arm 9 that engages with the locking portion 2 of the female housing A. It also has a cam follower pin 10 similar to the cam follower pin 3 of the female housing and which is formed at the lower portion on one of facing side walls.

The cam member C consists of an elliptical rotary plate 12, which has a rotating shaft 13 projecting from its back at the center with an elliptical rotary retainer plate 14 formed at the tip thereof. The rotary plate 12 also has in the back surface a pair of cam grooves 15, 15', formed symmetrical about the rotating shaft 13 which extend nearly in the direction of the major axis of the rotary plate 12 and which have introductory grooves 15*a* formed parallel to the major axis at the top of the upper groove 15 and the bottom of the lower groove 15'. On the front surface, the elliptical rotary plate 12 has a bulged portion 16 extending along the major axis through the center.

The cam grooves 15, 15', are formed along an elliptic curve such that their distances to the rotating shaft 13 of the rotary plate 12 change continually, with the dead ends of the cam grooves being nearest the rotating shaft 13 and the open inlets (introductory grooves 15*a*) farthest from it. The two cam grooves are so designed that the distance between the dead ends 15*b* of the grooves is equal to that between the cam follower pins 3, 10 when the female and male housings A, B are engaged completely. The size of the rotary retainer plate 14 is determined in a way to allow its insertion into and pulling out of the elliptical engagement completion opening 6, and its minor axis (shortest diameter) $D_1$ is made sufficiently larger than the width $D_2$ of the pin guide groove 4.

Figure 3A:
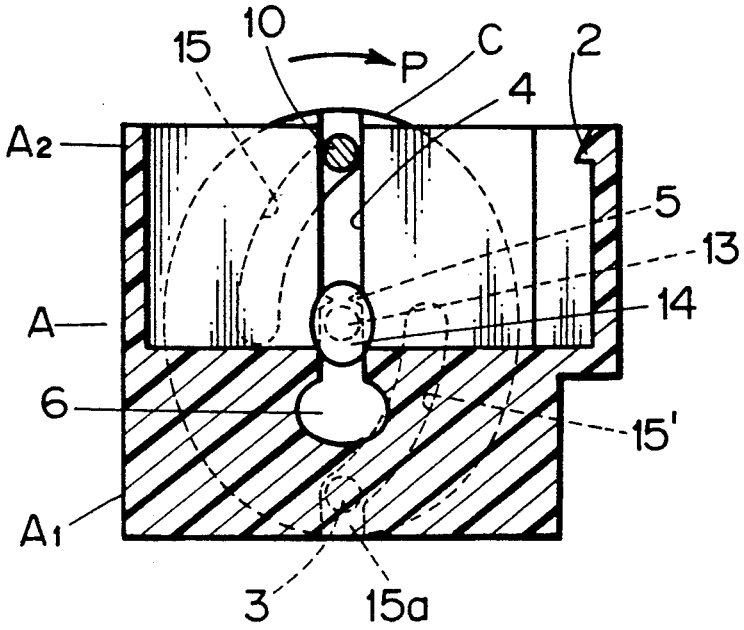
FIGS. 3A and 3B are cross sections taken along the line X—X of FIG. 1, FIG. 3A showing the position of the cam member before the female and male housings are engaged and FIG. 3B the cam member position after the engagement.

In the above construction, the assembly process will be explained below. First, the rotating shaft 13 is inserted into the pin guide groove 4 with the bulged portion 16 of the cam member C aligned with the direction of the pin guide groove 4 of the female housing A. When the rotating shaft 13 comes into contact with the preliminary locking projection 5, one should push it with force and thereby move it beyond the projection 5, at which time the cam follower pin 3 enters into the introductory groove 15*a* of the lower cam groove 15', as shown in FIG. 3A. The cam member C is now rotatable about the rotating shaft 13 inserted in the pin guide groove 4. It is also prevented from slipping off the groove 4 by the rotary retainer plate 14 and is loosely locked between the preliminary locking projection 5 and the cam follower pin 3.

In the above preliminary locked state, FIG. 3A also shows the male housing B disposed opposite to the hood $A_2$ in an initial engagement state with its cam follower pin 10 set into the inlet of the upper cam groove 15 through the introductory groove 15*a*. To avoid complexity of the drawing, FIG. 3A omits the male housing B, showing only the cam follower pin 10.

Figure 3B:
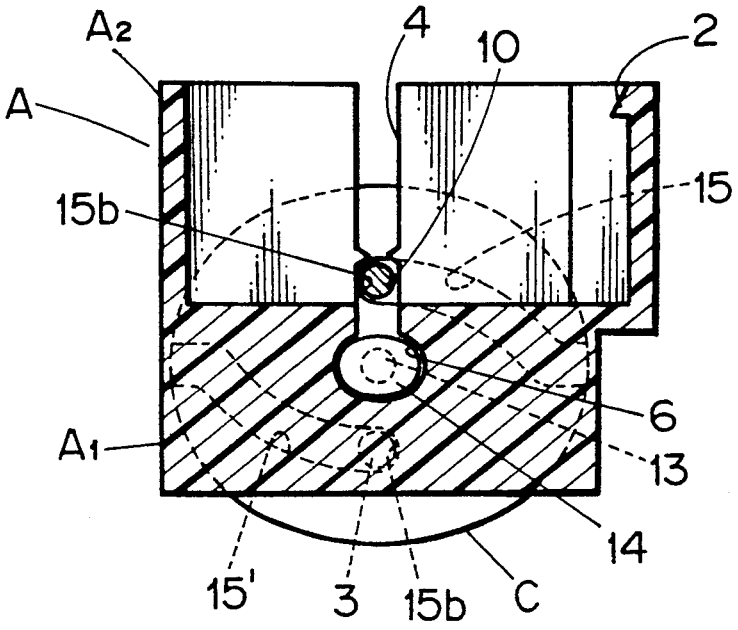

As the cam member C is rotated in the direction of arrow P by using the bulged portion 16, the cooperation between the engaged cam grooves 15, 15'and cam follower pins 10, 3 causes the male housing B and the female housing A to move toward the rotating shaft 13, with the result that the rotating shaft 13 is forced to move to the engagement completion opening 6. FIG. 3B shows the complete engagement state that is reached after the cam member C has been turned 90 degrees from the initial engagement state to bring the female and male housings A, B into complete engagement and the rotary retainer plate 14 of the rotating shaft 13 has come to the engagement completion opening 6. Only in this condition can the rotary retainer plate 14 be pulled out of the engagement completion opening 6 to remove the cam member C.

Figure 4A:
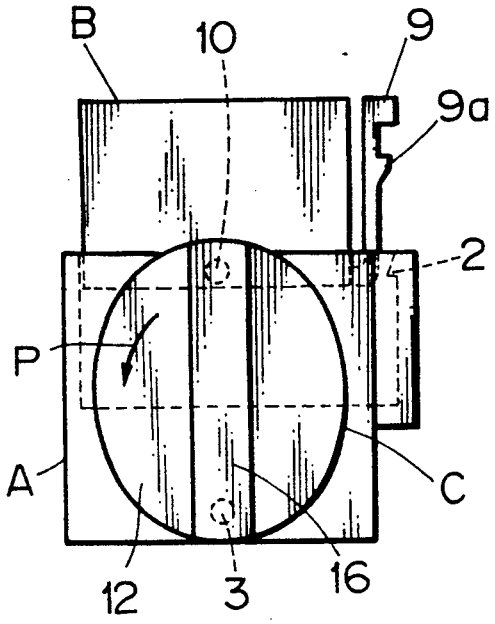
FIGS. 4A through 4D are plan views showing the process of engagement between the female and male housings.
Figure 4B:
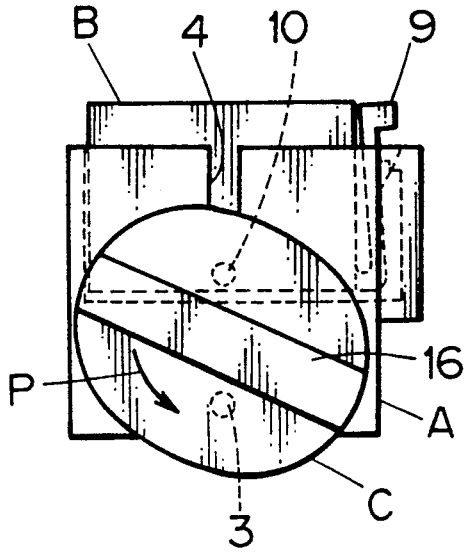
Figure 4C:
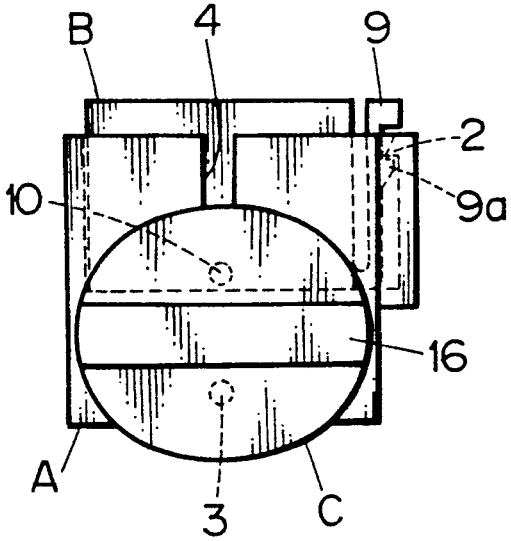
Figure 4D:
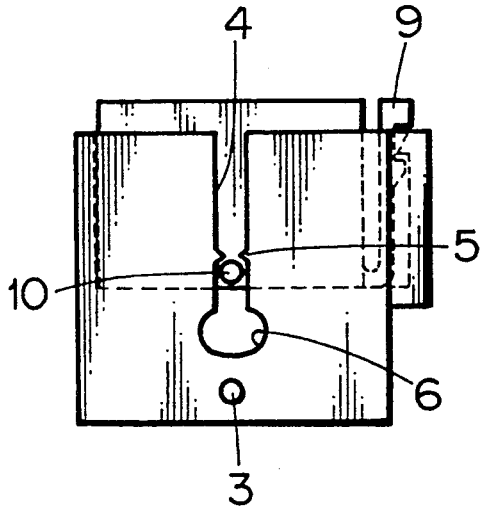
Figure 5:
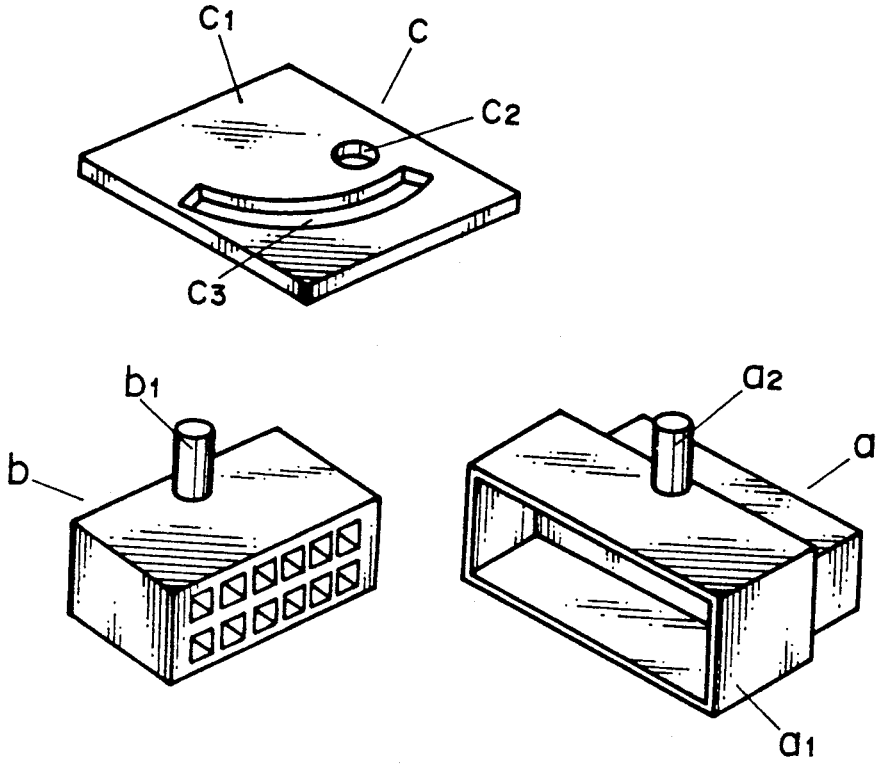
FIG. 5 PRIOR ART
FIG. 5 is an exploded perspective view of a conventional low-operating-force connector.
Figure 6:
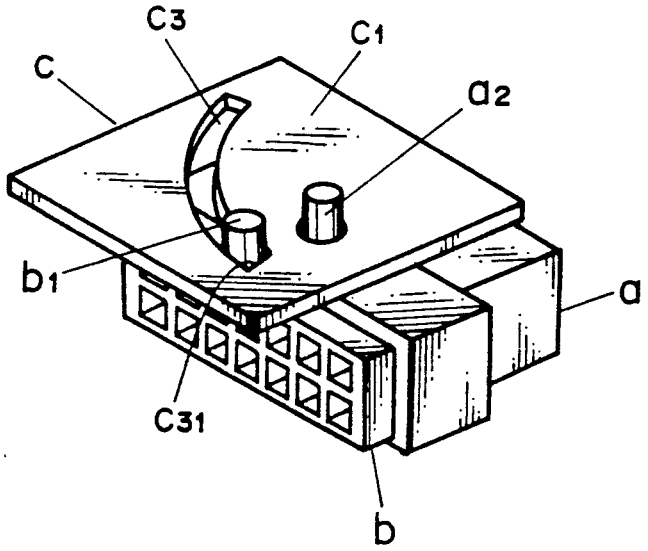
FIG. 6 PRIOR ART
FIG. 6 is a perspective view of the assembled connector of FIG. 5.

FIGS. 4A through 4D are plan views showing the process of engaging the female and male housings A, B. FIG. 4A represents the initial engagement state; FIG. 4B represents an intermediate state of engagement where the cam member C is turned 45 degrees in the direction of arrow P; FIG. 4C represents a completely engaged state where the female and male housings A, B are completely engaged together with a projection 9*a* of the lock arm 9 of the male housing B engaged with the locking portion 2 of the female housing A; and FIG. 4D indicates a state where the cam member C has been removed in the completely engaged state. Disengaging the female and male housings A, B need only reverse the above procedure.

The rotation of the cam member C causes the female and male housings A, B to move toward each other for engagement. Since the cooperation between the engaged cam follower pins 10, 3 and cam grooves 15, 15' requires a small operating force in rotating the cam member C during the coupling process, the assembly work can be done very easily. Further, since the cam member C cannot be removed during the process of engagement, it is possible to forestall any incomplete engagement of the mating housings. Another advantage is that since the rotary plate 12 of the cam member C is formed elliptic, the assembly worker can see at a glance how deeply the two housings are engaged.

While in the above embodiment the engagement completion opening 6 of the female housing A and the rotary retainer plate 14 of the cam member C are shown to be elliptical, they may be formed into any shape, like circle, diamond and the like, as long as the rotary retainer plate 14 can be removed from the engagement completion opening 6 in the completely engaged state. Similarly, the rotary plate 12 of the cam member C is not limited to the elliptic shape.

The advantages of the invention may be summarized as follows.

Since the cam member is permitted to be removed only when the female and male housings are completely engaged, any incomplete engagement of the housings can be prevented. In other words, this construction can provide a low-operating-force connector which assures a complete engagement of the mating housings and therefore has high electrical connection reliability. Unlike the conventional connectors, since this connector employs the cam member rotated to cause its mating female and male housings to move toward each other for engagement, the coupling and decoupling of the housings can be performed with ease. Thus, the connector of this invention is suitably applied to multi-terminal connectors.

What is claimed is:

1. A low-operating-force connector comprising:

a cam member consisting of a rotary plate, said rotary plate being formed with two cam grooves symmetrical about a rotating shaft of the rotary plate and with introductory grooves leading to the cam grooves, said rotating shaft having a rotary retainer plate at the end thereof; and a pair of mating housings adapted to be engaged by rotating the cam member, said paired housings each having a cam follower pin that engages with the corresponding cam groove of the cam member, one of said paired housings being provided with a pin guide groove that guides the cam follower pin of the other housing and the rotating shaft of the cam member, said pin guide groove having at its dead end an engagement completion opening from which the rotary retainer plate of the rotating shaft of the cam member can be pulled out when the paired housings are completely engaged together.

2. A low-operating-force connector as claimed in claim 1, wherein said pin guide groove further has at an intermediate portion thereof a preliminary locking projection for preventing said rotating shaft of the cam member from accidentally coming off said pin guide groove after having been inserted into said pin guide groove and moved beyond said preliminary locking projection.

3. A low-operating-force connector as claimed in claim 1, wherein said housing with the pin guide groove further has a locking projection adapted to engage with a locking arm provided to the other housing for locking the housings together when the housings are completely engaged.

4. A low-operating-force connector as claimed in claim 1, wherein said rotary plate of the cam member is of an elliptical form.

* * * * *